US007458717B2

(12) United States Patent
Baumberger et al.

(10) Patent No.: US 7,458,717 B2
(45) Date of Patent: Dec. 2, 2008

(54) DETENT ESCAPEMENT FOR TIMEPIECE

(75) Inventors: Peter Baumberger, Chemin Creux 18, 2503 Bienne (CH); Jean-François Mojon, Geneveys (CH)

(73) Assignee: Peter Baumberger, Bienne (CH)

( * ) Notice: Subject to any disclaimer, the term of this patent is extended or adjusted under 35 U.S.C. 154(b) by 0 days.

(21) Appl. No.: 12/088,242

(22) PCT Filed: Sep. 29, 2006

(86) PCT No.: PCT/EP2006/066884

§ 371 (c)(1), (2), (4) Date: Apr. 2, 2008

(87) PCT Pub. No.: WO2007/039558

PCT Pub. Date: Apr. 12, 2007

(65) Prior Publication Data

US 2008/0219103 A1 Sep. 11, 2008

(30) Foreign Application Priority Data

Sep. 30, 2005 (EP) ..... 05109056

(51) Int. Cl.
*G04B 15/00* (2006.01)

(52) U.S. Cl. ..... 368/127; 368/129

(58) Field of Classification Search ..... 368/124–133, 368/169

See application file for complete search history.

(56) References Cited

U.S. PATENT DOCUMENTS

| | | | | |
|---|---|---|---|---|
| 180,290 | A | 7/1876 | Voigt | |
| 3,505,805 | A * | 4/1970 | Brashear et al. | 368/133 |
| 4,002,021 | A * | 1/1977 | Dubois et al. | 368/129 |
| 6,301,981 | B1 * | 10/2001 | Oechslin | 74/1.5 |
| 6,712,500 | B2 * | 3/2004 | Tu et al. | 368/126 |
| 6,942,378 | B2 * | 9/2005 | Hayek et al. | 368/127 |
| 7,192,180 | B2 * | 3/2007 | Hayek et al. | 368/127 |
| 2005/0122847 | A1 * | 6/2005 | Hayek et al. | 368/127 |

FOREIGN PATENT DOCUMENTS

| | | |
|---|---|---|
| CH | 3299 | 3/1891 |

* cited by examiner

*Primary Examiner*—Vit W Miska
(74) *Attorney, Agent, or Firm*—Young & Thompson

(57) ABSTRACT

An escapement for a timepiece movement includes a toothed escape wheel, a balance and a detent respectively pivoted on rotation axes. The detent supports a pallet lock that interacts with the first tooth of the escape wheel along a certain length of penetration in order to block it in an idle phase during which the balance executes a free arc of oscillation. An impulse pallet rotationally driven by the balance interacts with a second tooth when the detent is pivoted in order to release the escape wheel, this wheel turning by a forward pitch before being blocked again by the pallet lock by interaction with the second tooth. The escapement also includes a limiting plate, which is coaxial and rotationally secured to the balance, has a periphery including a substantially circular main portion and a cutout positioned facing the pallet lock in the release phase.

20 Claims, 8 Drawing Sheets

DETENT ESCAPEMENT FOR TIMEPIECE

TECHNICAL FIELD

The present invention concerns a detent escapement for a timepiece, of the type comprising a toothed escape wheel and a balance, pivoted on first and second axes, respectively. More precisely, the escapement according to the invention also comprises a detent supporting a locking pallet designed to cooperate with a first tooth of the escape wheel, along a certain length of penetration, in order to block it in a locking phase Moreover, the detent is mounted in rotation on a third axis so as to be able to free the first tooth in an unlocking phase. An impulse pallet, integral with the balance while moving coaxially in relation to the oscillations thereof, is designed to cooperate with a second tooth of the escape wheel to receive an impulse from said wheel after the locking phase.

PRIOR ART

Detent escapements of this type have already been described in the prior art, such as, for example, in patent CH 3299, issued Mar. 5, 1891 to Emile James.

This document describes an escapement structure comprising a detent having the form of a lever pivoted at one of its ends. This escapement comprises a balance supporting small and large plates on its axis, the small plate supporting a discharging pallet making it possible to pivot the detent, while the large plate supports a notch fulfilling the role of an impulse palette, arranged so as to cooperate with the teeth of an escape wheel. The detent also comprises a locking pallet designed to interact with the teeth of the escape wheel to block the latter during periods of free oscillation of the balance.

To enable pivoting of the detent, said detent supports an elongated spring, which is made integral with the detent in the region of its end by which it pivots and, whereof the free end is located on the path of the discharging pallet of the small plate. Thus, the latter part acts on the spring, in a first direction of rotation of the balance, to cause the detent to pivot and enable the escape wheel to turn one pitch forward, while it simply crosses the spring through elastic deformation of said spring, in the other direction of rotation of the balance.

It can be seen that one of the main recognized advantages of the detent escapement arises from the fact that, during operation, the impulse from the escape wheel to the balance is given only one time through oscillation of the latter, which causes a loss of energy related to the inertia of the escape wheel weaker than in an anchor escapement.

However, the operation of unlocking the detent through interaction of the discharging pallet with the detent spring, as well as the inertia of the detent in its pivoting, constitute non-negligible disturbance factors for the oscillation movement of the balance, all the more significant since the balance is small.

These drawbacks of the detent escapement, in particular, combined with the implementation of unsecured mechanical connections making it particularly sensitive to shocks, have limited its spread in modern watches, despite its obvious technical advantages.

Moreover, patent U.S. Pat. No. 180,290, issued Jul. 25, 1876 in the name of F. H. Voigt, describes a detent escapement in which the first and second teeth are adjacent and arranged on either side of the center straight line joining the first and second axes in the locking phase. This structure is advantageous because the fact of working by locking and by impulse on the teeth of the escape wheel which are closest to the balance minimizes the impact of disturbances due to the unlocking phase on the oscillations of the latter.

However, this escapement does not comprise a safety measure to prevent untimely unlocking of the escape wheel in case of shock, which makes it particularly unsuitable from the perspective of potential implementation in a portable watch.

BRIEF SUMMARY OF THE INVENTION

One primary aim of the present invention is to propose an alternative detent escapement structure making it possible to obtain higher efficiency as well as increased safety against shocks in relation to the known mechanisms of the prior art.

To this end, the invention relates to a detent escapement of the type mentioned above, characterized by the fact that it also comprises a limiting plate, coaxial and rotationally secured to the balance, having a periphery comprising a substantially circular main portion as well as a cutout made so that it is positioned facing the locking pallet in the unlocking phase. Moreover, the limiting plate is dimensioned in such a manner as to define a safety distance separating the locking pallet from the main circular portion when they are positioned facing each other, less than the length of penetration of the locking pallet on the first tooth of the escape wheel.

Thanks to these characteristics, the amplitude of the pivoting movements of the detent is limited, in case of shock, directly through the interaction of the locking pallet and the limiting plate, without it being necessary to provide for additional elements to ensure this function. Thus, the efficiency and reliability of the escapement according to the present invention are sufficient to allow their implementation in timepieces having small dimensions, due in particular to the fact that the escape wheel cannot be discharged following a shock taking place outside the unlocking phase.

In one preferred embodiment of the invention, the above aim is achieved while also limiting the bulk of the escapement to allow its implementation in timepieces having small dimensions, such as wristwatches. Indeed, according to one advantageous characteristic, the straight line defined by the third axis of the detent and the locking pallet is substantially perpendicular to the center straight line, which makes it possible to reduce the bulk of the escapement substantially.

In one preferred variation of embodiment, the escapement comprises a discharging pallet integral with the balance and coaxial thereto, while the detent supports a spring whereof one portion is arranged on the path of the discharging pallet.

Moreover, one can provide that the balance comprises an additional small and large plate, both integral with the balance and centered on the second axis, the small plate supporting the discharging pallet while the large plate supports the impulse pallet.

Alternatively, one can provide for the impulse pallet to be supported directly by the limiting plate, the latter then also acting as the conventional large plate.

In this case, one can consider that the impulse pallet has an impulse surface located at a distance from the second axis smaller than or equal to the average radius of the limiting plate, and that the periphery of the latter also has a recess arranged facing the impulse surface to make said surface accessible. The cutout is then arranged on the opposite side of the impulse pallet in reference to the recess, to enable unlocking of the locking pallet when the discharging pallet causes the detent to pivot.

In additional embodiments of the escapement according to the present invention, it also comprises an anti-tripping device, i.e. a device making it possible to limit the rotation of the escape wheel to a single pitch at each oscillation of the balance.

BRIEF DESCRIPTION OF THE DRAWINGS

Other characteristics and advantages of the present invention will appear more clearly upon reading the following detailed description of preferred embodiments, done in reference to the appended drawings provided as non-limiting examples and in which.

EMBODIMENT(S) OF THE INVENTION

Figure 1:
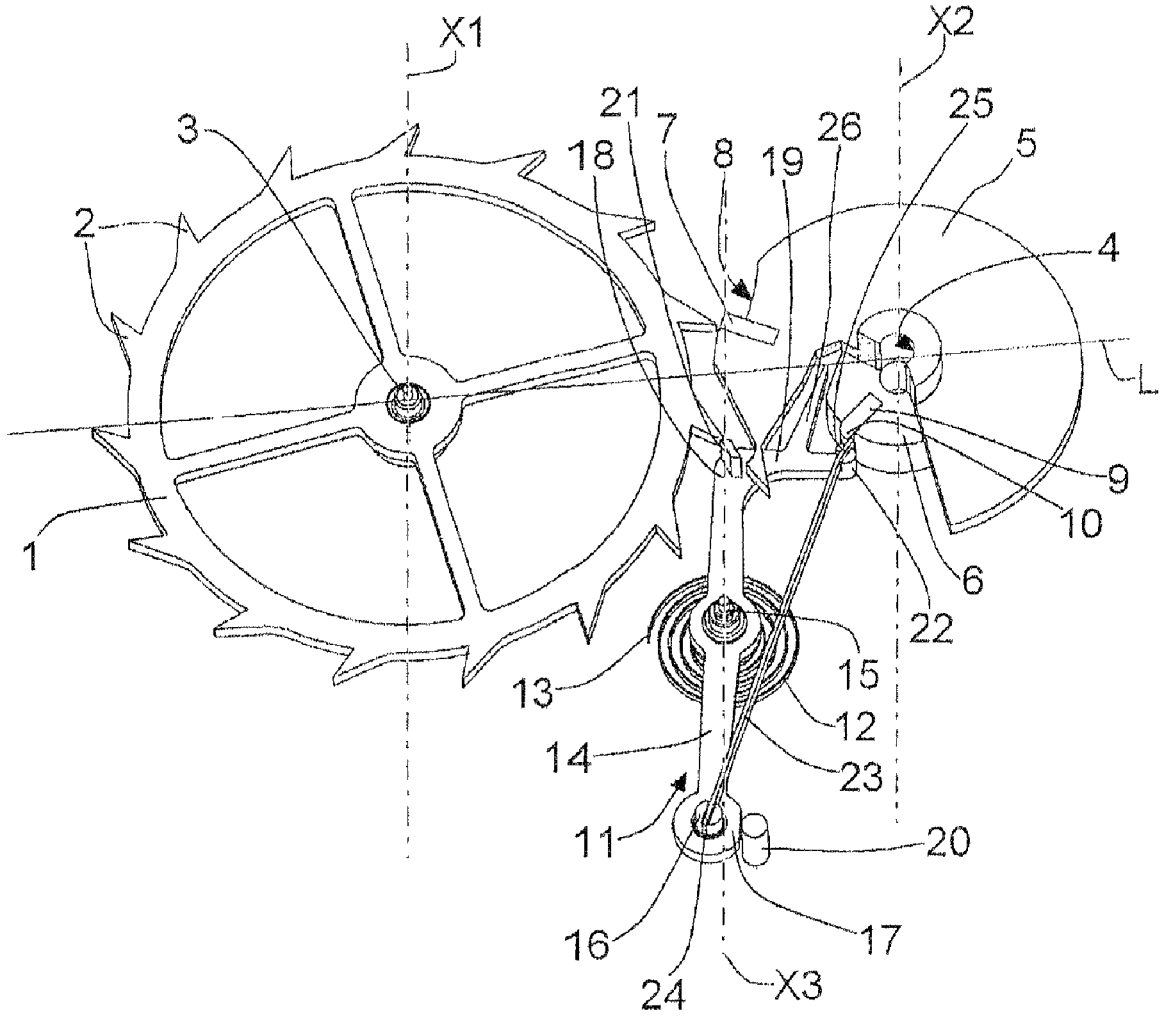
FIG. 1 illustrates a simplified perspective view of the detent escapement according to a first preferred embodiment of the present invention, part of its component elements being removed to make certain others visible.

FIG. 1 shows a simplified perspective view of the basic component elements of a detent escapement according to one preferred embodiment of the present invention. Part of these elements, normally concealed, have been made visible to expose the general operating principle.

This timepiece escapement is intended to be integrated into a timepiece movement (not shown) comprising in particular a mechanical energy source, such as a barrel spring. Thus, the escapement is connected to this energy source, through a gear train, by an escape wheel 1. The escape wheel 1 is of the conventional type and is shown here with fifteen teeth 2, as a non-limiting example. It is designed to be mounted on the clockwork movement by a pivot 3 defining its axis of rotation X1.

The escapement also comprises a balance whereof only the site of the pivot 4 is diagrammed for reasons of clarity The balance is mounted in rotation in relation to a second axis, referenced X2 in FIG. 1.

Figure 2A:
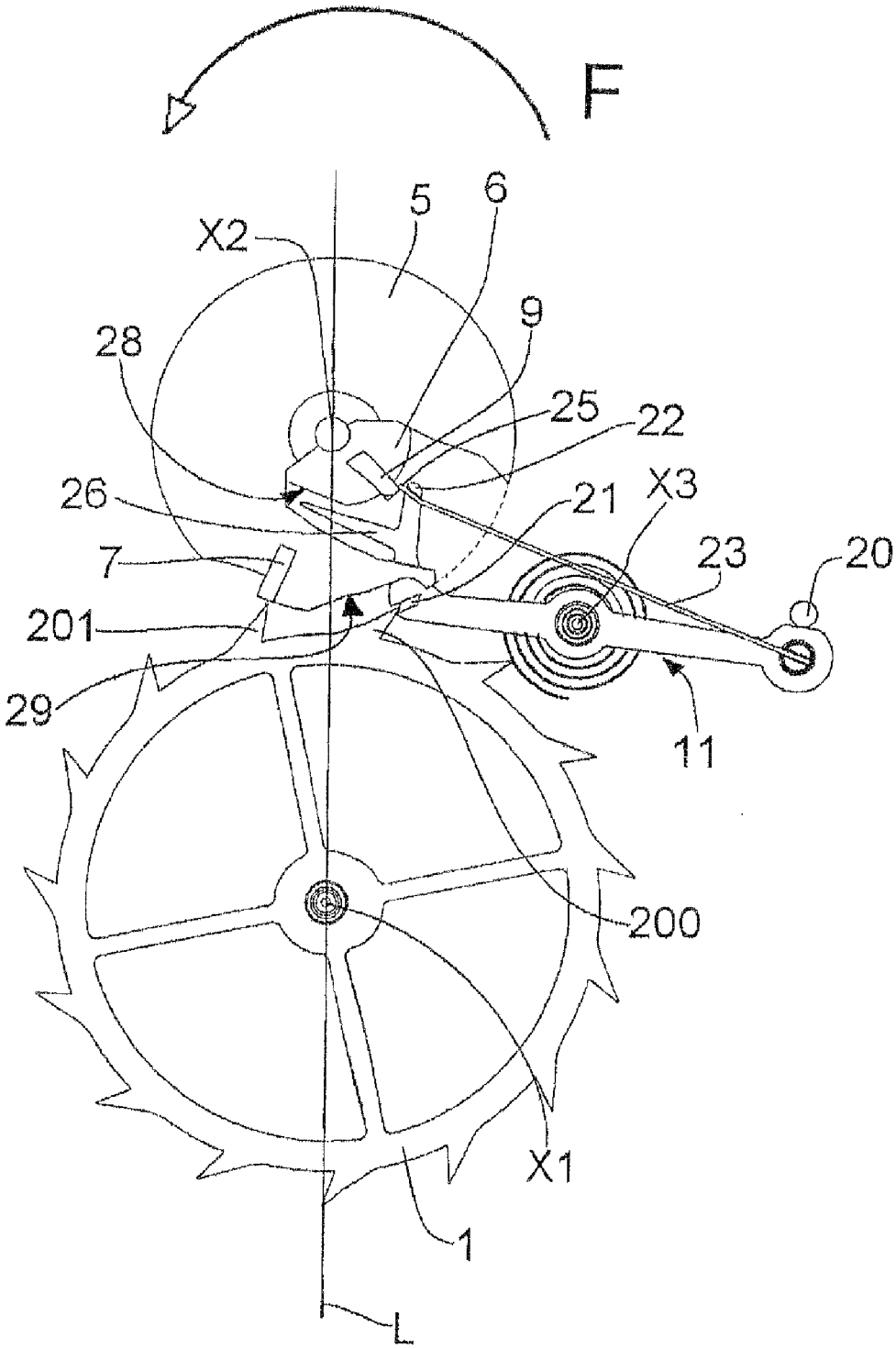
FIG. 2*a* shows a simplified top view of the detent escapement visible in FIG. 1, in a first phase of its operation.
Figure 2B:
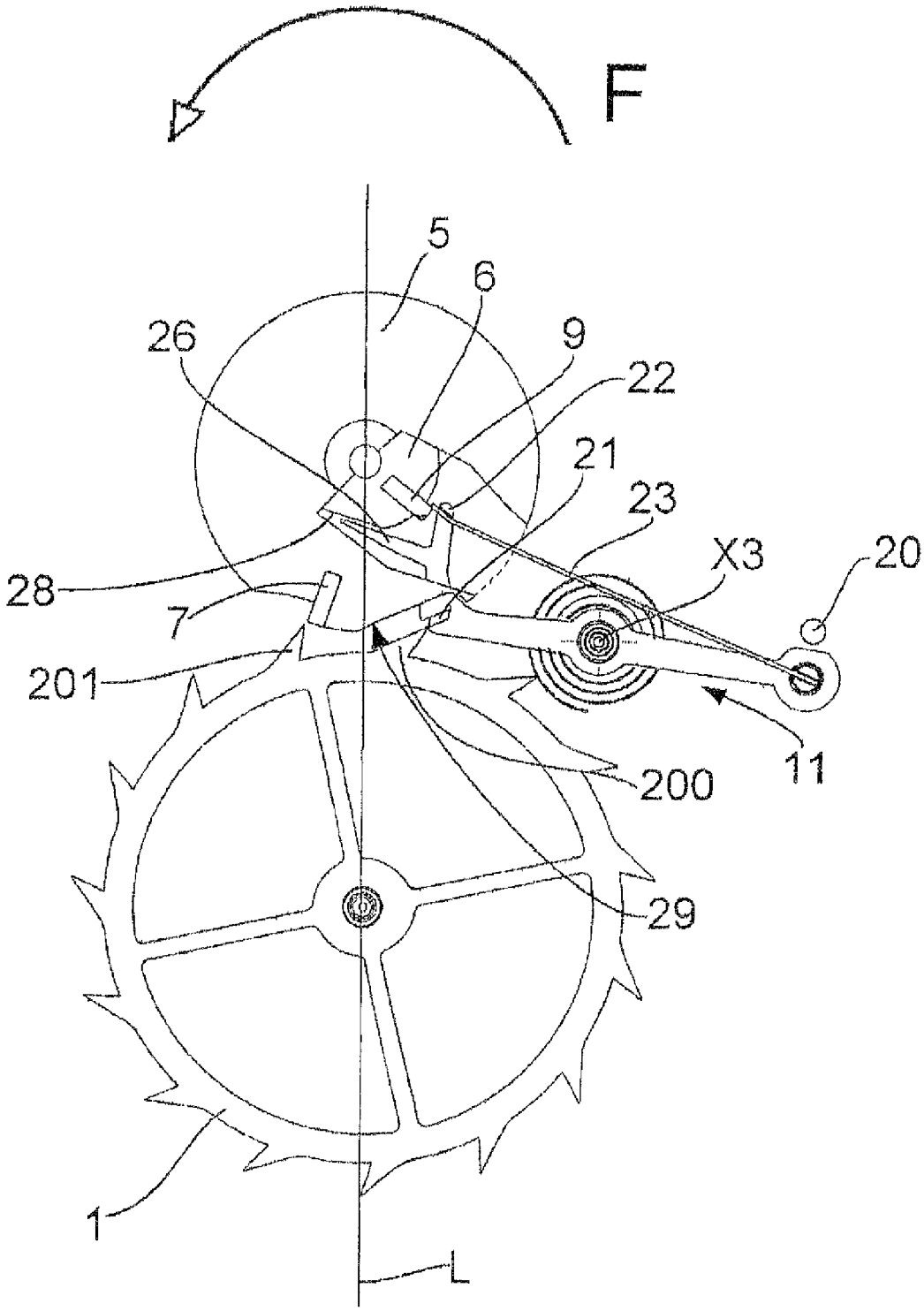
FIG. 2*b* shows a view similar to that of FIG. 2*a*, in a second phase of operation.
Figure 2C:
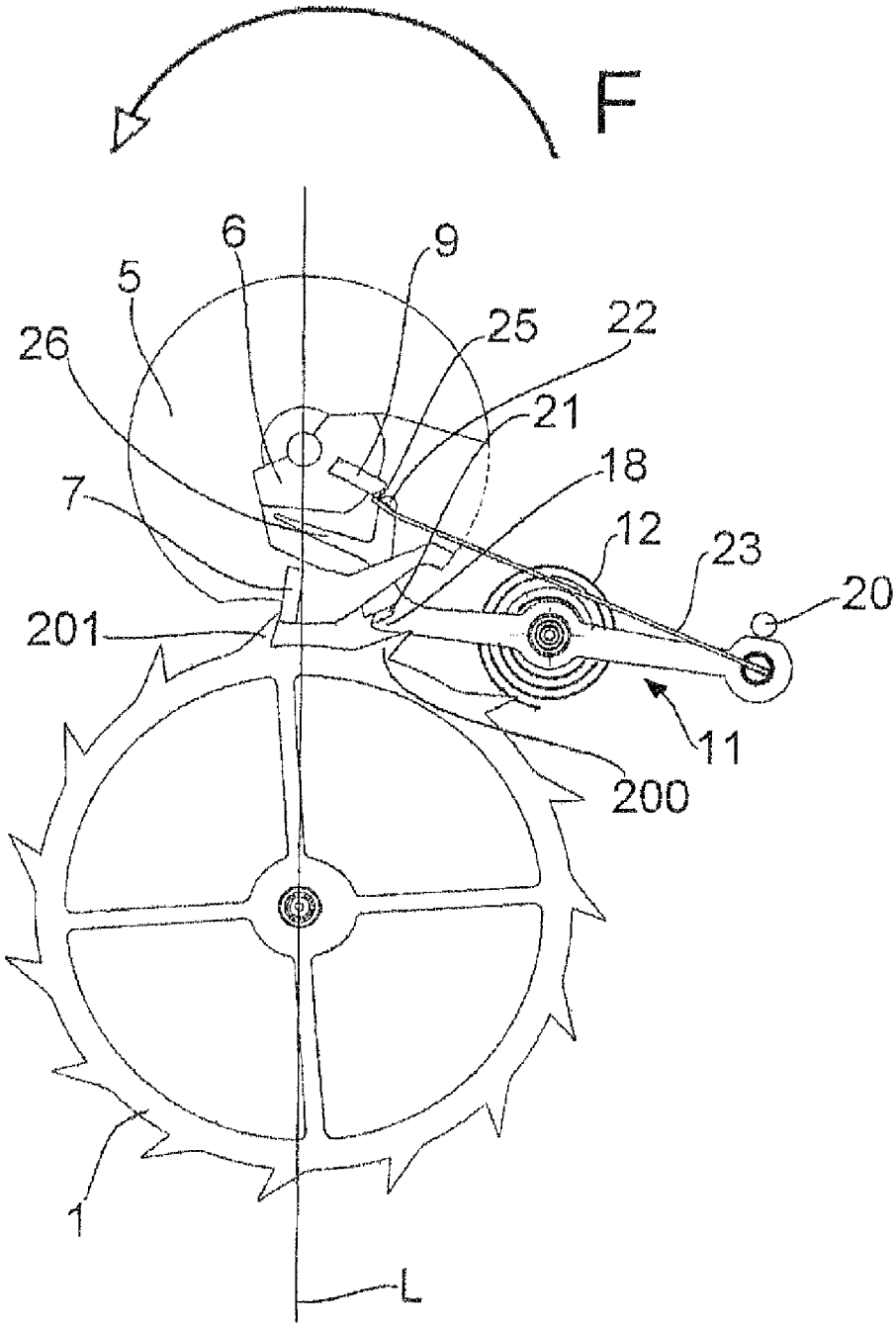
FIG. 2*c* shows a view similar to that of FIG. 2*a*, in a third phase of operation.
Figure 2D:
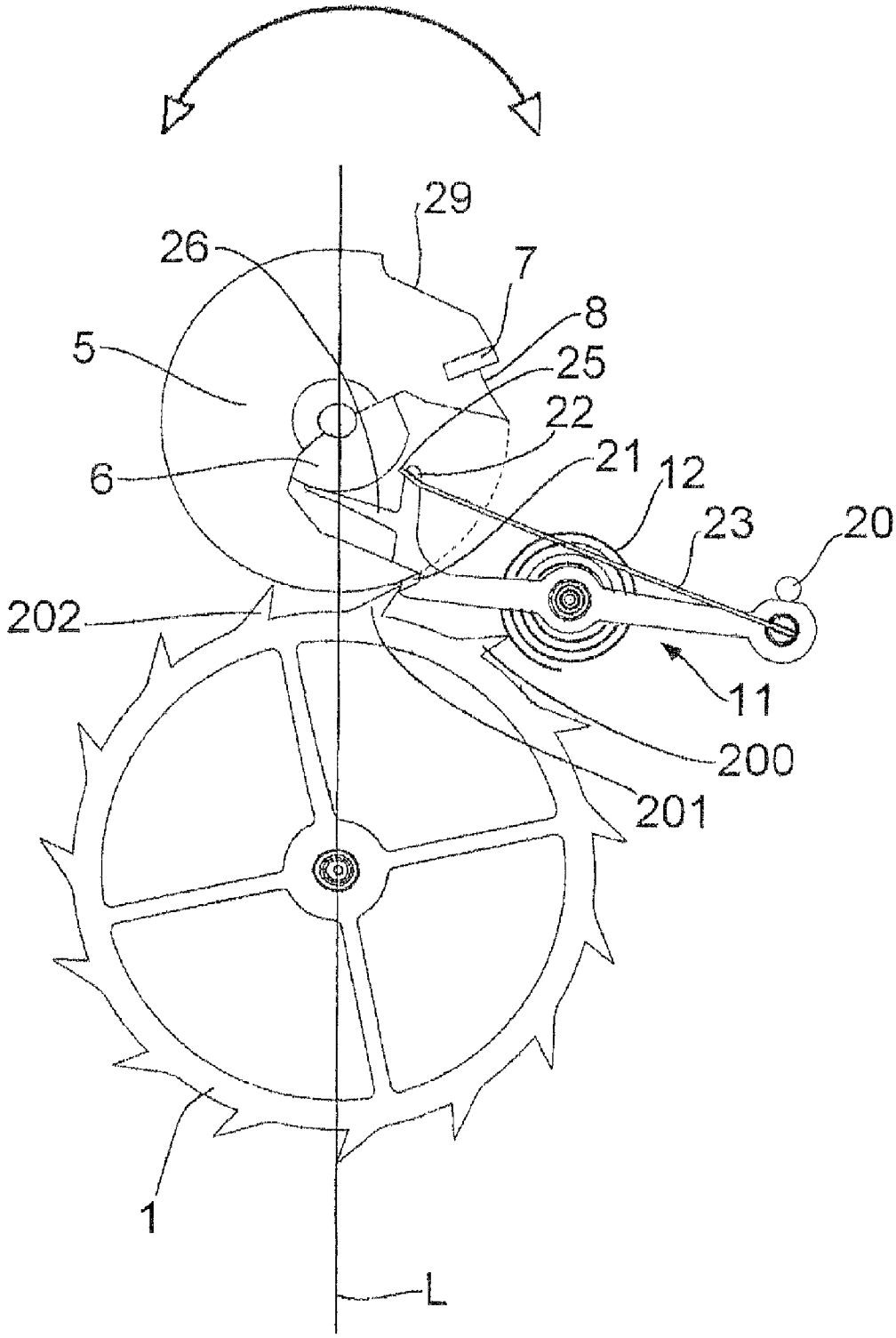
FIG. 2*d* shows a view similar to that of FIG. 2*a*, in a fourth operating phase.

In a first preferred embodiment of the present invention, described in relation to FIGS. 1 to 2*d*, a large plate 5 and a small plate 6 are integral with the arbor 4 of the balance and coaxial thereto. The small plate is visible in the figures thanks to the fact that a portion of the large plate has been omitted for the purposes of this description.

The large plate 5 supports an impulse plate 7 whereof the end having the impulse surface is located at a distance from the axis X2 equal to the general radius of the large plate 5. Thus, the impulse surface is made accessible by a cutout of the large plate forming a recess 8 facing this surface.

The small plate 6 supports a discharging pallet 9 whereof one end 10 is arranged protruding in relation to the perimeter of the small plate. The angular position of the discharging pallet is predefined in reference to the position of the impulse pallet on the large plate and one skilled in the art will not encounter any particular difficulties in adjusting the relative positions of these two pallets.

Moreover, the escapement comprises a detent 11 mounted in rotation in reference to a third axis, referenced X3 in FIG. 1. A balance spring 12 is fixed by its outer end 13 to the clockwork movement, while its inner end (not shown) is integral with the detent 11.

The detent 11 comprises a rectilinear main arm 14 whereof the central region is mounted on a pivot 15 of the axis X3. The main arm supports a split pin 16 at a first end 17, while its second end 18 is extended by a bend, itself followed by a short rectilinear portion 19 extending in a direction substantially perpendicular to the direction of the main arm.

The balance spring 12 acts on the main arm 14 of the detent 11 to return the latter to a predefined angular orientation through the positioning of a pin 20, integral with the clockwork movement and designed to cooperate with a flat portion arranged on the first end 17 of the detent. One may possibly bind the pin to the clockwork movement using an eccentric part to enable its adjustable positioning, in a known manner.

On one hand, the detent 11 supports a locking pallet 21 mounted in the region of the second end 18 of the main arm and designed to cooperate with the teeth 2 of the escape wheel, as appears in FIG. 1.

On the other hand, the detent also supports a banking 22 having a substantially semi-cylindrical shape at the free end of the rectilinear portion 19, in other words, near the small plate 6.

A detent spring 23, having a generally rectilinear shape, is arranged on the detent 11 so as to have a first end 24 housed in the slot of the split pin 16 and its second end 25 disposed abutting against the flat portion of the banking 22. One can see that the second end 25 has a small angle in relation to the general direction of the spring 23, conventionally.

One may note that the short rectilinear portion 19 comprises a finger 26 extending from the central part of the portion 19, in a direction substantially tangential to the perimeter of the small plate 6, and ending in a point. The function of this finger 26 will be explained below in relation to the detailed description of the operation of the escapement which has just been described.

In general, the primary steps of the kinematics of this escapement are conventional insofar as they comprise a locking phase, during which the escape wheel is blocked and the balance executes a free arc of oscillation, an unlocking phase during which the escape wheel is freed to transmit an impulse to the balance, and a blocking of the escape wheel initiating a new locking phase during which the balance resumes its free oscillation.

These steps will now be described below in relation to the detailed description of FIGS. 2*a* to 2*d*.

FIG. 2*a* is a top view of the escapement illustrated in FIG. 1, the configuration and relative positions of its various component elements being identical to those of FIG. 1.

As previously mentioned, the locking pallet 21 is arranged so as to cooperate with the teeth 2 of the escape wheel, more precisely with the tooth 200 at the moment shown in FIG. 2*a*.

The escape wheel 1 is subject to a permanent force tending to cause it to turn, clockwise, due to its kinematic link with the energy source of the movement. The interaction of its tooth 200 with the locking pallet 21 ensures its blocking in the position of the detent illustrated in FIG. 2*a*.

The balance executes a free arc of oscillation in the direction indicated by the arrow F, at the moment shown, due to the fact that the discharging pallet 9 supported by the small plate 6 comes into contact with the end 25 of the detent spring 23. At the same time, the impulse pallet 7, supported by the large plate 5, is positioned in the region of a tooth 201 adjacent to the tooth 200 but also located out of reach of the impulse pallet.

It should be noted here that, if the line of centers L is defined as being the straight line going through the first and second axes X1 and X2, the teeth 200 and 201 are located on either side of this line of centers L. Thus, these teeth are the two teeth of the escape wheel 1 which are closest to the axis X1 of rotation of the balance. As mentioned above, this particular characteristic contributes to reducing the impact of disturbances related to the inertia of the detent on the oscillations of the balance.

Moreover, it appears in FIG. 1 that, remarkably, the straight line going through the axis X3 and the locking pallet 21 is substantially perpendicular to the line of centers L.

One may also note that the finger 26 of the detent is arranged facing a flat portion 28 of the perimeter of the small plate 6, formed by a cutout thereof. Simultaneously, the locking pallet 21 is located facing a cutout 29 arranged in the perimeter (partially illustrated in the form of a broken line) of the large plate 5 of the side opposite that of the recess 8, in reference to the position of the impulse pallet 7.

FIG. 2*b* shows the escapement a brief moment after that of FIG. 2*a*, when it is at the end of the unlocking phase.

The rotational movement of the balance in the direction of the arrow F causes the appearance of a force exerted by the discharging pallet 9 on the end 25 of the spring 23, in the same direction. The presence of the banking 22 on the detent 11 prevents the spring 23 from losing its shape, which results in transmitting the force exerted by the discharging pallet to the detent 11, which pivots on its axis X3 during the unlocking phase.

At the end of this phase, the locking pallet 21 leaves the tooth 200 of the escape wheel to free the latter, the movement of the locking pallet being made possible, in the particular case illustrated, due to the presence of the cutout 29 of the large plate. This feature will be explained in further detail in relation to the description of FIG. 2*d*. Likewise, the finger 26 of the detent follows the same movement as the locking pallet in coming closer to the small plate 6, such a movement of the finger being possible due to the presence of the flat section 28 of the small plate.

One observes in FIG. 2*b* that while the balance has continued its rotation, the escape wheel 1 has not begun to turn, which explains that between FIGS. 2*a* and 2*b*, the impulse pallet 7 has moved to pass in front of the tooth 201 of the escape wheel and prepare the impulse phase.

FIG. 2*c* shows the device of the preceding figures at the beginning of the impulse phase.

The locking pallet has left the tooth 200, freeing the escape wheel 1, the latter thus being driven in rotational movement by the energy source of the clockwork movement, in the direction opposite that indicated by the arrow F.

In the meantime, the discharging pallet 9 has crossed the spring 23 by pivoting of the detent 11 and the balance begins a new free arc of oscillation. The detent 11 being simultaneously relieved of the force previously exerted by the discharging pallet, it is thus subjected only the return force of its balance spring 12 which tends to return its second end 18 in the direction of the escape wheel 1. The locking pallet 21 then moves away from the large plate 5 while the finger 26 moves away from the small plate 6.

The simultaneous movements of the balance and the escape wheel 1 cause the positioning of the impulse pallet 7 on the path of the tooth 201, which comes into contact with it, at the moment illustrated in FIG. 2*c*. An impulse is thus transmitted from the escape wheel to the balance to ensure the maintenance of the oscillations of the latter.

After the impulse phase, the impulse pallet 7 leaves the path of the tooth 201 by simultaneous rotation of the balance and the escape wheel, as illustrated in FIG. 2*d*. One can see that both the impulse pallet and the tooth 201 cross the line of centers L during the impulse phase.

The balance continues the ascending free arc of oscillation, while the locking pallet 21 finds itself positioned on the path of the tooth 201 due to the rotational movement of the detent 11. The escape wheel 1 is consequently once again blocked for a new locking phase, the tooth 201 replacing the tooth 200 in its earlier role as banking cooperating with the locking pallet of the detent. At the same time, the tooth 202 has positioned itself near the large plate, on the side of the line of centers L opposite that of the tooth 201, waiting for the next impulse phase.

In this configuration, the locking pallet 21 is located at a distance from the axis X1 greater than the maximum radius of the large plate 5 while the finger 26 is located at a distance from the axis X1 greater than the maximum radius of the small plate 6.

Thus, when the balance completes its ascending arc and reverses the direction of its rotation to execute the following descending arc, the locking pallet and the finger remain out of reach of the large and small plates, respectively.

During the descending arc of the balance, the discharging pallet 9 once again encounters the end 25 of the detent spring 23 which, in this direction, can change shape to unlock itself from the banking 22 of the detent, and thus enable passage of the discharging pallet with minimal disturbance of the movement of the balance The crossing of the spring by the discharging pallet is preferably optimized by the realization of a rounded portion at the edge of the pallet, which raises the spring during the descending arc. The spring 23 again bears against the banking 22 once its end 25 is freed by the discharging pallet 9.

The balance then completes its ascending arc before executing a new descending arc to find itself again in the situation shown in FIG. 2*a*, with the small difference that the escape wheel 1 has turned by one pitch in the clockwise direction.

Now that the escapement according to a first preferred embodiment has been described, it should be noted that a certain number of variations may be considered without going outside the framework of the invention.

One will note in particular that the relative dimensions and positions of the plates and the escape wheel, as illustrated in FIGS. 1 to 2*d*, are a means of optimizing the bulk of the escapement.

More specifically, FIG. 2*d* illustrates the fact that the average radius of the large plate 5 is preferably chosen such that the perimeter of the plate defines a banking for the locking pallet 21 during the locking phases. The safety distance separating the locking pallet from the large plate is preferably smaller than the length of penetration of the locking pallet on the tooth of the escape wheel. Thus, in case of shock, if the detent were to undergo a force tending to cause it to turn clockwise, the locking pallet would abut against the large plate before having freed the tooth of the escape wheel, the latter thus acting as a limiting plate.

One may provide, as an alternative or complement to that which has been described above in relation to the safety distance, another system such as that which was previously described in relation with FIGS. 1 to 2*d*, namely the fact that the finger 26 cooperates with the perimeter of the small plate 6. One can in fact adjust the dimensions of the finger as well as its distance relative to the perimeter of the small plate such that this distance is smaller than the penetration of the locking pallet on the tooth of the escape wheel.

One skilled in the art will not encounter any particular difficulties in adapting the escapement to his own needs by providing one of these protective devices against shocks or both at the same time. Likewise, he can define the best compromise according to his needs with regard to the safety distance separating the locking pallet from the large plate.

It is, of course, understood from the preceding that the recess 8 and the cutout 29 of the large plate 5 are not absolutely necessary to implementation of the present invention. As will appear below, in relation to the description of FIG. 5, other embodiments are possible in order to arrive at the same level of efficiency of the escapement according to the present invention.

Moreover, implementation of the present invention is also not limited to the use of a discharging pallet associated with a detent spring. As an example, one can alternatively provide for a structure such as that described in patent application EP 1 544 689 A1, already cited by way of prior art. The device disclosed in this document should then be adapted to take into account the fact that the locking pallet and the part of the detent which cooperates with the small plate are located on the same side of the detent in reference to the axis of rotation X3 of the latter. Thus, the finger acting on the detent should be arranged near the small plate, while the guide curve ensuring the return of the locking pallet in the direction of the escape wheel must face the axis of rotation X1 of the balance, while being arranged away from the small plate.

Variations of embodiments of the escapement according to the present invention will now be described in relation to FIGS. 3, 4*a* and 4*b*.

Figure 3:
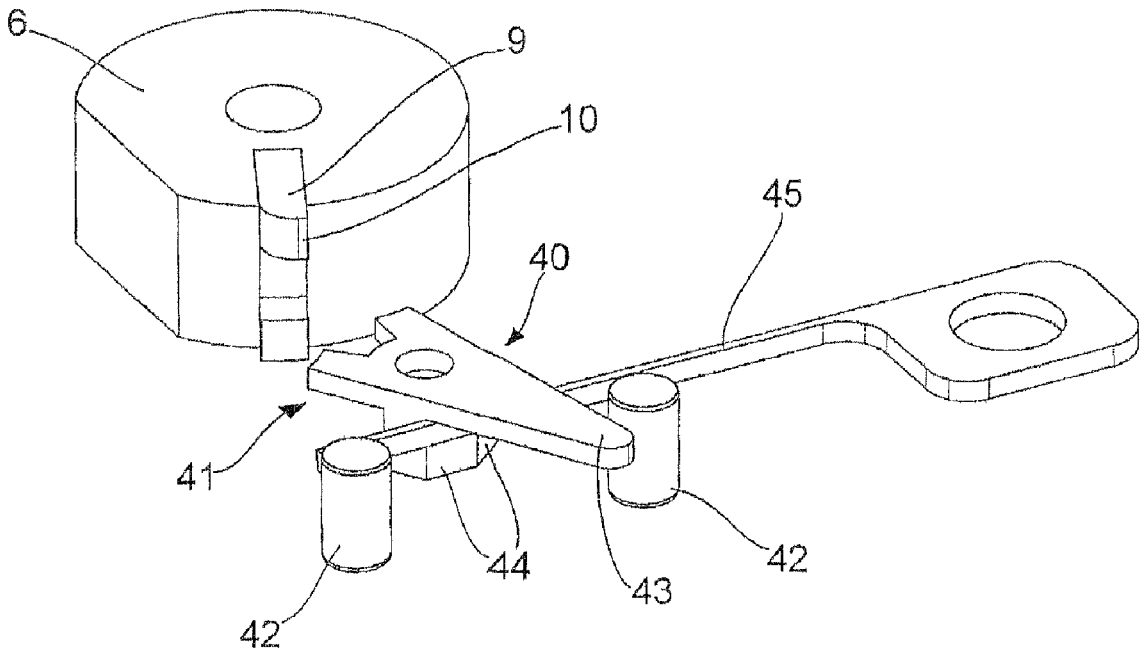
FIG. 3 shows a simplified perspective view of a detail of the escapement according to an additional embodiment.

FIG. 3 is a perspective view illustrating an anti-tripping system complementary to the device described above making it possible to strengthen the safety of the latter. Only the elements essential to the comprehension of this system have been illustrated in this figure.

The anti-tripping system according to this variation comprises a lever 40 including a fork 41 and mounted pivoting on the clockwork movement, near the small plate 6. The pivot amplitude of the lever is limited by two bankings 42, designed to cooperate with the end 43 of the lever farthest from the small plate. The lever 40 also comprises two tilted planes 44 arranged so as to cooperate with a jumper 45 to define two stable positions of the lever corresponding to the banking positions. The fork 41 is arranged sufficiently close to the small plate to be able to interact with the discharging pallet 9.

Thus, upon each passage of the discharging pallet in the fork, the pallet exerts pressure on the internal surface of the fork to cause the lever 40 to tilt from one extreme position to the other.

Similarly to the operation of the fork in a Swiss anchor, the fork 41 defines two stops for the small plate in case of tripping, or knocking, to prevent the balance from executing more than one turn around its pivot axis X1.

One skilled in the art will not encounter any particular difficulties in arranging the anti-tripping lever in the region of the small plate, according to his needs and the space at his disposal on the plate of his clockwork movement.

Figure 4A:
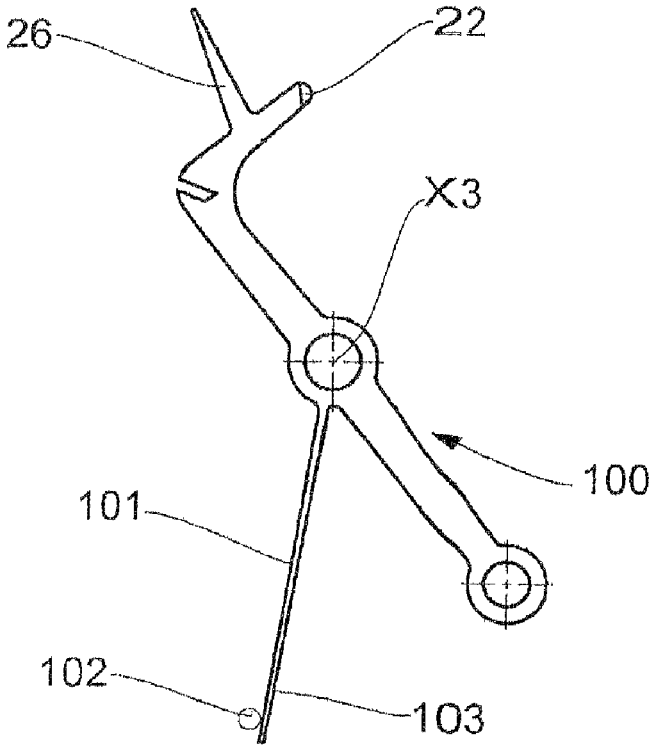
FIGS. 4*a* and 4*b* are simplified top views of a second detail of construction of the escapement, according to a first and second preferred embodiment, respectively.
Figure 4B:
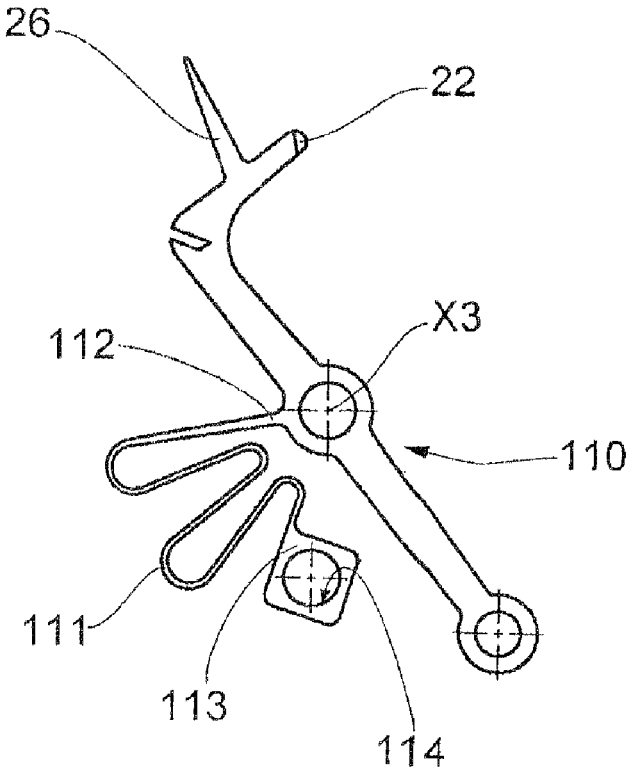

FIGS. 4*a* and 4*b* illustrate particular variations of embodiments of the spring making it possible to return the detent to a predefined position, thereby offering alternatives to the balance spring 12 which was previously described in relation to the primary embodiment.

According to these two variations, the spring is formed integrally with the detent. As a result, the latter is shown alone in FIGS. 4*a* and 4*b*, the other components of the escapement being in accordance with that which was described above.

FIG. 4*a* shows a first variation of the detent 100 comprising a flat leaf spring 101 extending in a rectilinear direction from the central region of the detent, near its axis of rotation X3. For implementation of this structure, it is necessary to provide a banking 102, integral with the clockwork movement and designed to prevent rotation of the free end 103 of the spring in the unlocking phase to return the detent to its locking position, i.e. in the position it occupies during the locking phases of the escape wheel 1.

FIG. 4*b* illustrates a second variation of the detent 110 comprising a spring 111 having a winding shape. The spring 111 comprises a first end 112 integral with the central region of the detent 110, while its second end 113 is fixed on the clockwork movement using any suitable means, such as a hole 114 made directly in its end 113 and designed to cooperate with a screw or an eccentric element to allow adjustment of the return force (not visible), for example.

The realization of the return spring of the detent according to these two variations makes it possible to reduce the number of parts necessary while also simplifying the assembly of the detent in relation with this spring.

Of course, the two variations above are provided only as illustrative examples and one skilled in the art will not encounter any particular difficulties in adapting the shape of the return spring to his own needs.

Figure 5:
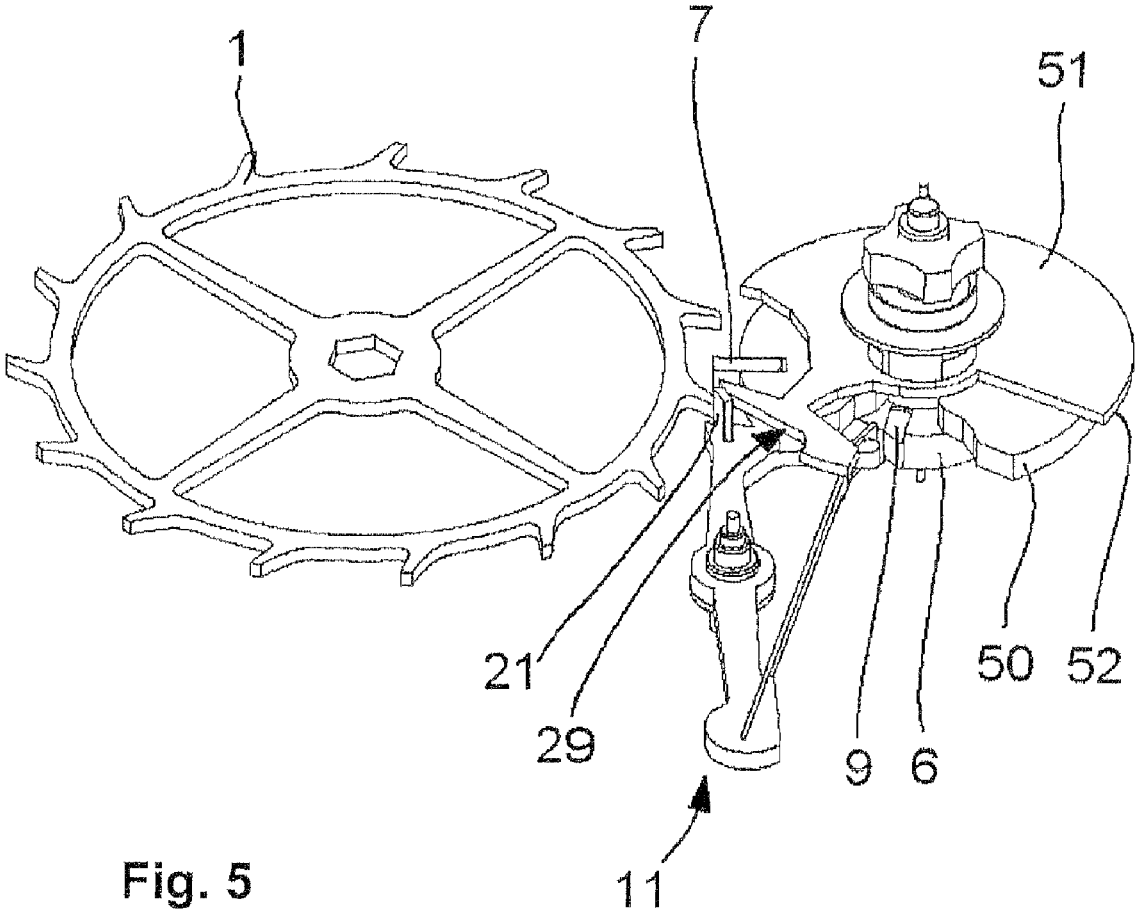
FIG. 5 illustrates a simplified perspective view of the detent escapement according to an additional preferred embodiment of the present invention, part of its component elements being removed to make certain others visible.

FIG. 5 shows a simplified perspective view, similar to that of FIG. 1, of the detent escapement according to an additional preferred embodiment of the invention. Some of the component elements of the escapement have been removed to make certain others visible.

The elements already described in relation to the preceding figures use the same numerical references for increased clarity.

The large plate 50 is disk-shaped, has a radius smaller than that of the large plate 5 of the first embodiment, and comprises a notch wherein is housed the impulse pallet 7. Due to its reduced diameter, the large plate 50 does not act as the limiting plate but simply acts as a support for the impulse pallet, conventionally.

In return, a limiting plate 51, as such, is provided to fulfill this role in the present embodiment. This is mounted coaxially to the small 6 and large 50 plates, while being integral with the balance. It has a periphery whereof a primary portion 52 is circular in shape, while a cutout 29 is arranged in a predefined angular position in reference to the position of the impulse pallet 7, similarly to that which was described in relation with the first embodiment.

The average radius of the limiting plate 51 is chosen such that the periphery of the latter is located at a safety distance smaller than the length of penetration of the locking pallet 21 on the teeth of the escape wheel 1 outside the unlocking phase. Moreover, as previously mentioned, the cutout 29 is positioned facing the locking pallet during the unlocking phase to allow pivoting of the detent 11.

From the perspective of its operation, the escapement of FIG. 5 is similar to that of FIG. 1; this point therefore will not be discussed in detail.

Of course, one skilled in the art can modify the relative positions of the plates 6, 50 and 51 according to his needs without going outside the framework of the present invention. Moreover, all of the variations previously described can also be applied to this additional embodiment.

The preceding description is intended to describe particular embodiments as a non-limiting illustration and the invention is not limited, for example, to the particular form of the detent or the various springs, or to the means enabling implementation of the unlocking.

The invention claimed is:

1. A detent escapement for timepiece comprising a toothed escape wheel, pivoted on a first axis (X1), a balance, pivoted on a second axis (X2) and whereto an impulse pallet is coaxial and secured, a detent supporting a locking pallet designed to cooperate with a first tooth of said escape wheel, along a certain length of penetration, to block said first tooth in a locking phase, said detent being pivoted on a third axis (X3) to be capable of freeing said first tooth in an unlocking phase, said impulse pallet being designed to cooperate with a second tooth of said escape wheel to receive an impulse from the latter after said unlocking phase, said first and second teeth being adjacent and arranged on either side of a center straight line (L) joining said first (X1) and second (X2) axes in said locking phase, wherein it also comprises a limiting plate, coaxial and rotationally secured to said balance, having a periphery comprising a substantially circular main portion as well as a cutout arranged so as to be positioned across from said locking pallet in said unlocking phase, and wherein said limiting plate is dimensioned so as to define a security distance, separating said locking pallet from said circular main portion when they are positioned facing each other, less than said length of penetration.

2. The escapement of claim 1, comprising an additional small and large plate, both integral with said balance and centered on said second axis (X2), said small plate supporting a discharging pallet while said large plate supports said impulse pallet, said detent supporting a spring whereof one portion is arranged on the path of said discharging pallet.

3. The escapement of claim 2, wherein said limiting plate has a diameter larger than the respective diameters of said small and large plates.

4. The escapement of claim 1, comprising a small plate, integral with said balance and centered on said second axis (X2), supporting a discharging pallet, said detent supporting a spring whereof one portion is arranged on the path of said discharging pallet, said impulse pallet being supported by said limiting plate.

5. The escapement of claim 4, wherein said impulse pallet has an impulse surface located at a distance from said second axis (X2) smaller than or equal to the average radius of said limiting plate, and wherein said periphery of said limiting plate also has a recess arranged across from said impulse surface, to make it accessible, said cutout being arranged on the side opposite said impulse pallet in reference to said recess.

6. The escapement of claim 2, wherein said detent comprises a main arm mounted pivoting on said third axis (X3) through a central region and at a first end of which is fixed said spring, while said locking pallet is mounted on its second end, said main arm being extended by a bend, after its second end, itself extended by a short portion supporting a banking for said portion of the spring located on the path of said discharging pallet, said short portion also supporting a finger extending in a direction substantially tangential to the periphery of said small plate, the angle separating said finger from said small plate in reference to said third axis X3 being smaller than that corresponding to said length of penetration of said looking pallet on said first tooth of the escape wheel, and said small plate having a truncated portion on its periphery, arranged so as to be across from said finger when said discharging pallet is arranged in contact with said spring.

7. The escapement of claim 3, wherein wherein said detent comprises a main arm mounted pivoting on said third axis (X3) through a central region and at a first end of which is fixed said spring, while said locking pallet is mounted on its second end, said main arm being extended by a bend, after its second end, itself extended by a short portion supporting a banking for said portion of the spring located on the path of said discharging pallet, said short portion also supporting a finger extending in a direction substantially tangential to the periphery of said small plate, the angle separating said finger from said small plate in reference to said third axis X3 being smaller than that corresponding to said length of penetration of said locking pallet on said first tooth of the escape wheel, and said small plate having a truncated portion on its periphery, arranged so as to be across from said finger when said discharging pallet is arranged in contact with said spring.

8. The escapement of claim 1, wherein said cutout has, from a region of said main portion of the periphery of the limiting plate distant from said impulse pallet, a first short portion having a curved contour followed by a ramp longer than said first portion, substantially rectilinear and extending in the direction of said impulse pallet until it rejoins said main portion.

9. The escapement of claim 2, wherein said cutout has, from a region of said main portion of the periphery of the limiting plate distant from said impulse pallet, a first short portion having a curved contour followed by a ramp longer than said first portion, substantially rectilinear and extending in the direction of said impulse pallet until it rejoins said main portion.

10. The escapement of claim 3, wherein said cutout has, from a region of said main portion of the periphery of the limiting plate distant from said impulse pallet, a first short portion having a curved contour followed by a ramp longer than said first portion, substantially rectilinear and extending in the direction of said impulse pallet until it rejoins said main portion.

11. The escapement of claim 1, comprising elastic means arranged to exert a force on said detent tending to engage said locking pallet in the space separating two adjacent teeth from said escape wheel, said elastic means being formed in one piece with said detent.

12. The escapement of claim 2, comprising elastic means arranged to exert a force on said detent tending to engage said locking pallet in the space separating two adjacent teeth from said escape wheel, said elastic means being formed in one piece with said detent.

13. The escapement of claim 3, comprising elastic means arranged to exert a force on said detent tending to engage said locking pallet in the space separating two adjacent teeth from said escape wheel, said elastic means being formed in one piece with said detent.

14. The escapement of claim 11, wherein said elastic means comprise a spring having a winding shape whereof a first end is integral with said detent while its second end has a predefined fixed position relative to said detent.

15. The escapement of claim 12, wherein said elastic means comprise a spring having a winding shape whereof a first end is integral with said detent while its second end has a predefined fixed position relative to said detent.

16. The escapement of claim 13, wherein said elastic means comprise a spring having a winding shape whereof a first end is integral with said detent while its second end has a predefined fixed position relative to said detent.

17. The escapement of claim 2, comprising an anti-tripping lever, able to pivot between two extreme stable positions along an axis parallel to said second axis, and having at least one contact surface arranged so as to cooperate with said discharging pallet to cause said anti-tripping lever to pivot from one extreme position to the other.

18. The escapement of claim 3, comprising an anti-tripping lever, able to pivot between two extreme stable positions along an axis parallel to said second axis, and having at least one contact surface arranged so as to cooperate with said discharging pallet to cause said anti-tripping lever to pivot from one extreme position to the other.

19. Movement for timepiece comprising an escapement according to any of the preceding claims, an energy source and a gear train ensuring the kinematic connection between said energy source and the escape wheel of said escapement.

20. Timepiece comprising a movement according to claim 19.

* * * * *